United States Patent [19]

Turney et al.

[11] Patent Number: 5,005,305

[45] Date of Patent: Apr. 9, 1991

[54] MAGNETICALLY OPERATED DISPLAY DEVICE

[75] Inventors: David L. Turney, Plano, Tex.; Morris Relson, Great Neck, N.Y.

[73] Assignee: Gulton Industries, Inc., Plano, Tex.

[21] Appl. No.: 424,891

[22] Filed: Oct. 20, 1989

[51] Int. Cl.[5] ..... G09F 9/30

[52] U.S. Cl. ..... 40/449; 340/815.05; 340/815.27

[58] Field of Search ..... 40/449, 446, 447; 340/815.24, 815.26, 815.27, 764, 815.05, 815.04

[56] References Cited

U.S. PATENT DOCUMENTS

| | | | |
|---|---|---|---|
| 2,740,955 | 4/1956 | Barrett | 340/815.24 |
| 3,942,274 | 3/1976 | Winrow | 40/449 |
| 4,243,978 | 1/1981 | Winrow | 340/815.26 |
| 4,531,318 | 7/1985 | Chang et al. | 40/449 |
| 4,577,427 | 3/1986 | Browne | 40/449 |
| 4,860,470 | 8/1989 | Browne | 40/449 |

*Primary Examiner*—Peter R. Brown
*Assistant Examiner*—J. Bonifanti
*Attorney, Agent, or Firm*—Darby & Darby

[57] ABSTRACT

A magnetically operated display element having contrasting opposite sides, is symmetrically mounted in a surrounding frame for pivoting about an axis. A permanent magnet within the display element has poles on opposite sides of the pivoting axis. A U-shaped electromagnet has its pole pieces positioned on opposite sides of the pivoting axis where they may interact with the poles of the permanent magnet. The permanent magnet has a asymmetrical magnetic construction relative to the pivoting axis. When the electromagnet is energized, the repulsion at one pole of the permanent magnet is always greater than at the other pole of the permanent magnet, causing rotation of the display element. The display element is statically and dynamically balanced.

20 Claims, 1 Drawing Sheet

MAGNETICALLY OPERATED DISPLAY DEVICE

FIELD OF THE INVENTION

This invention relates generally to display devices for use as an operational indicator or as a unit in a matrix of similar units forming, for example, a sign or message board, and more particularly to a magnetically operated display device for such purposes.

BACKGROUND OF THE INVENTION

Magnetically operated display devices include a display or flip element, typically a disc, mounted for rotation about a central axis. A permanent magnet is positioned on the flip element with its magnetic poles substantially in the plane of the flip element and oriented transversely to the axis of rotation. A U-shaped electromagnet is positioned where its poles can attract or repel the poles of the permanent magnet in the flip element. By reversing the electromagnet pole polarity, the element can be flipped over, rotating on its axis. Rotation is limited to approximately 180 degrees by a mechanical stop, generally, a pole piece of the electromagnet. The opposite faces of the flip element, which is generally planar, present different appearances, one from the other, for example, a color difference. Many such devices are used in a matrix, to present indicia, for example, alphanumeric characters, which are readily distinguishable from their background. Devices of this general character are shown in U.S. Pat. Nos. 3,140,553; 3,283,427; 3,295,238; 3,363,494; 3,365,824; 3,518,664; 3,991,496 and 4,531,318.

A problem arises when it is desired to flip a display element if the forces generated between the poles of the electromagnet and the proximate poles of the permanent magnet are equal and opposite about the pivot axis. Then, although the mechanical stop arrangement prevents motion in one direction, there is no certainty that the indicia device will flip in the other desired direction. This difficulty can be overcome by limiting rotation of the indicia element to an angle less than 180 degrees. In such a construction, the fixed poles of the electromagnet act respectively to repel both poles of the permanent magnet on the element providing an additive force in the direction desired for flipping the device.

Another advantage to limiting rotation of the device to less than 180 degrees is that the device may be flipped over with less applied torque as compared to a starting condition where equal and opposite torques tend to be applied. However, this solution to the problem, which assures that the device will flip when the electromagnetic polarity is reversed, adversely affects the appearance of the display to a viewer because the face of the flip element is not truly perpendicular to the most preferred viewing angle, which is at a right angle to the device or matrix wherein the display device is utilized. Thus, as deviation in the turning angle from 180 degrees increases, that is as the turning angle decreases, the torque requirements for flip-over decrease but viewing quality also decreases. A compromise in construction must be made which has inherently undesirable consequences.

OBJECTS OF THE INVENTION

Accordingly, it is an object of this invention to provide an improved magnetically operated display device which may be a unit of a matrix of such devices and which provides a display element with a face to the viewer which is perpendicular to the preferred viewing angle.

Another object of this invention is to provide an improved magnetically operated display device which responds rapidly and positively to actuating signals without sacrifice in viewing quality.

Still another object of this invention is to provide an improved magnetically operated display device which is operable in all orientations.

Yet another object of this invention is to provide an improved magnetically operated display device which is economically produced and has long life in use.

In accordance with a preferred embodiment of the invention, a magnetically operated display device is provided which is especially suited for optimum viewability and positive reliable performance regardless of orientation. A display element or disc having contrasting opposite sides, is mounted in a surrounding frame for pivoting about an axis which symmetrically divides the surface of the disc element A permanent magnet, having its magnetic plane substantially coplanar with the disc element is located within the display device, with its poles on opposite sides of the pivoting axis.

A generally U-shaped electromagnet has its pole pieces positioned on opposite sides of the pivoting axis where they may interact with the poles of the permanent magnet. When the electromagnet is deenergized, the permanent magnet remains attracted to the poles of the electromagnet due to magnetic remanence of the electromagnet and the disc element remains in a fixed position.

The permanent magnet has an asymmetrical magnetic construction relative to the pivoting axis such that when the electromagnet is energized in a manner tending to repel both poles of the permanent magnet, that is, north against north and south against south, the repulsion at one pole of the permanent magnet is always greater then at the other pole of the permanent magnet. Rotation of the display device is thereby assured, provided that sufficient turning torque is produced. The amount of rotation is physically limited to approximately 180 degrees, by contact of the disc element with one or the other pole piece of the electromagnet which stops rotation. This contact occurs on the "strong side" of the permanent magnet. On the other side of the disc element axis, that is, where the permanent magnet pole has weaker interaction with the pole pieces, a cut-out is provided which clears the pole piece of the electromagnet during rotation Remanence in the electromagnet assures that the display element holds its last position in contact with one pole piece even after the electromagnet is deenergized. Thus, there is no flutter of the disc element and energy is conserved by not requiring continuous energization of the electromagnet.

One or more balancing weights are applied to the display element so that static and dynamic balance is achieved about the pivot axis, absent magnetic forces. Turning torques due to gravity are made equal and opposite on both sides of the pivoting axis and the moments of inertia are made equal on both sides of the pivoting axis. The center of gravity and rotational center are placed at the pivot axis. Thereby, reliable and quickly responsive operation is assured regardless of orientation of the display device or of any matrix wherein the display device is employed.

The flip element is made preferably by a double injection molding technique wherein a permanent magnet is sealed within plastic layers. Contrasting colors are provided for the layers by means of fillers in the plastic layer. In an alternative embodiment in accordance with the invention, the permanent magnet in the element comprises magnetized particles contained in a plastic matrix and distributed so as to produce an asymmetric magnetic construction relative to the pivoting axis of the display element.

Further objects and advantages of the invention will be apparent from the specification and drawing. The invention accordingly comprises the features of construction, combination of devices, and arrangement of parts which will be exemplified in the constructions hereinafter set forth, and the scope of the invention will be indicated in the annexed claims.

BRIEF DESCRIPTION OF THE DRAWINGS

For a fuller understanding of the invention, reference is had to the following description taken in connection with the in which.

DESCRIPTION OF THE PREFERRED EMBODIMENTS

Figure 1:
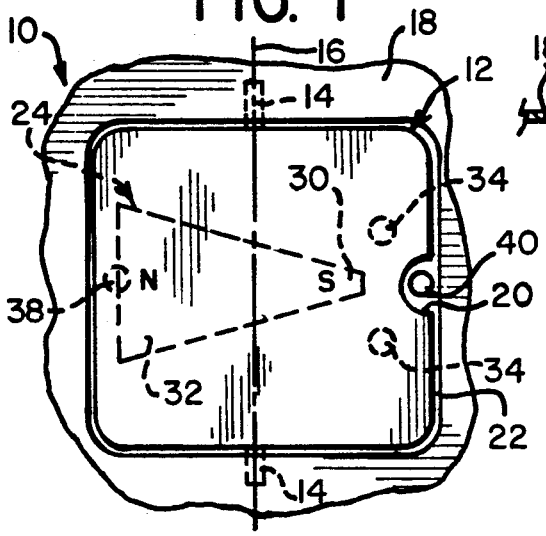
FIG. 1 is a plan view of a magnetically operated display device in accordance with the invention.

With reference to the figures, a magnetically operated display device 10 (sometime called a flip disc) in accordance with the invention includes a display or flip element 12, which may be square with rounded corners as shown, or other desired shape, such as round, oval, octagonal, etc. Pivots 14 are formed integrally on opposite edges of the element 12 and provide an axis 16 which divides the element 12 symmetrically with regard to its face area as seen in FIG. 1. The pivots 14 are supported in a frame 18 such that the display element 12 may pivot about the axis 16 as more fully described hereinafter. A semi-circular cut-out 20 is formed on one edge 22 of the display element 12.

A permanent magnet 24, having its magnetic axis (that is, the axis between the north and south pole) oriented transversely to the pivoting axis of rotation 16, is located in or on one face 26, 28 or between the front face 26 and rear face 28 of the element 12. The magnet 24 is preferably shaped as an isosceles triangle with the apex 30 directed toward and adjacent to (but spaced from) the cut-out 20. Other tapered shapes may be used. In the figures, the apex 30 is indicated as the south pole and the triangle's base 32 is indicated as the north pole. It will become apparent that either end of the magnet 24 could be the north or the south pole. The following description is based on the illustrated exemplary pole placement.

Because of the asymmetric positioning of the magnet 24 relative to the pivoting axis 16, balancing weights 34 may be incorporated into the display element 12 such that turning moments due to gravity are equal and opposite on both sides of the axis 16, absent magnetic influences. Further, the weights 34 are preferably sized and positioned such that the moments of inertia for rotation about the axis 16 for each side of the element (including the weights 34, magnet 24, and element material) are equal. Energy requirements for rotation of the element are reduced by such balancing of forces and moments.

Positioned behind the display element 12 is an electromagnet 36 which may be U-shaped, having a pair of symmetrically positioned pole pieces 38, 40 and a conductive winding 42 wrapped around a connective portion 44. The pole pieces are formed of a ferromagnetic material which partially retains magnetism (i.e. has magnetic remanence) after the electrical energization is removed. The cut-out 20 is positioned in alignment with one pole piece 40 such that when the display element 12 swings about the pivoting axis 16, there is no contact between the element 12 and the pole piece 40. The base 32 of the permanent magnet 24 is proximate the pole piece 38 and is attracted thereto when the electromagnet 36 and the permanent magnet 32 have the polarity shown. (The polarity of the pole pieces 38 and 40 is indicated with smaller letters than those used on the permanent magnet 24 to indicate a magnetic remanence in the electromagnet 36 rather than an energized condition.)

Figure 3:
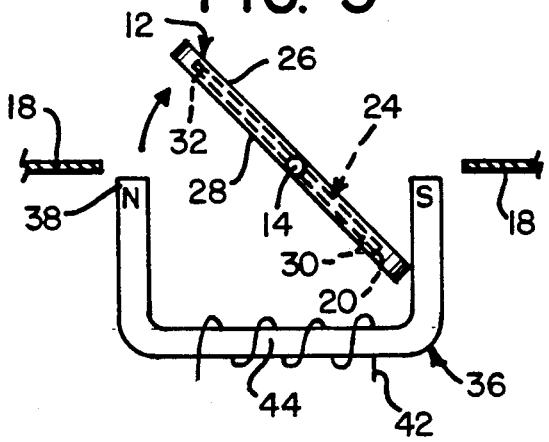
FIG. 3 is a view similar to FIG. 2, showing the display device in partially rotated position.

When the winding 42 is energized with a unidirectional current so as to change the pole piece 38 to a north polarity and the pole piece 40 to a south polarity (FIG. 3), the element 12 rotates, with the north end of the permanent magnet 32 being initially repelled by the pole piece 38. The south pole at the apex 30 of the permanent magnet 24 is initially repelled by the south pole 40, which tends to oppose the rotation. However, the repelling force resulting from the interaction between the pole 38 and the base 32 of the magnet is greater than the repelling force between the pole piece 40 and the apex 30 of the permanent magnet because of the spacing of magnet apex 30 from pole piece 40 and different flux distribution patterns. Therefore, the display element 12 pivots about the axis 16 in a clockwise direction, as illustrated in FIG. 3. After a small angle of rotation, there is a repelling action between magnet apex 30 and pole piece 40 which assists in the rotation. After the element 12 passes a central point, the polarities of the permanent magnet ends and the adjacent electromagnet poles become opposite, so that the element ends are attracted by both poles, respectively, until the surface 26 of the display element 12 rests against the fixed pole piece 40, which serves as a stop preventing further rotation of the element 12.

In this condition, the north pole of the permanent magnet 24 is attracted to the south pole presented by the pole piece 40 and the south pole of the permanent magnet 24 is attracted to the north pole presented by the pole piece 38, although there is no contact between the display element 12 and the north pole 38 due to the cut-out 20 which provides clearance therebetween. When the winding 42 is deenergized, as when the initiating current is a pulse of current, the display element 12 remains in the flipped-over position as a result of remanence flux in the pole pieces 38, 40 of the electromagnet 36.

Figure 2:
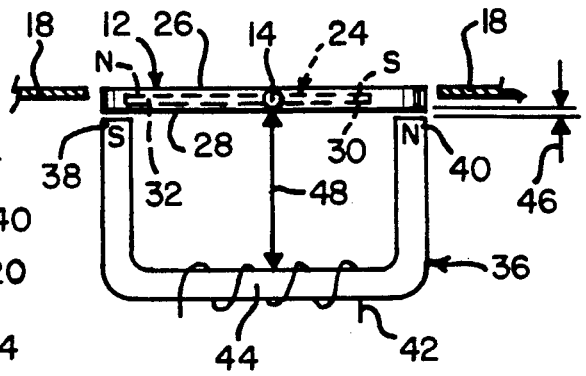
FIG. 2 is a side elevation view of the display device of FIG. 1.

By reversing the polarity of voltage applied to the winding 42, the display element 12 will similarly flip in a counterclockwise direction and return to the condition shown in FIG. 2.

A gap 46 is illustrated in FIG. 2 between the lower surface 28 of the display element 12 and the poles 38, 40 of the electromagnet 36. This condition is illustrated to simplify understanding of the construction. In actual practice, the greater attraction between the pole 38 and the base 32 of the permanent magnet 24 will bring the edge of the element 12, marked N in FIG. 2, in contact with the pole piece 38. Normally, the axis 16 will be substantially vertical, so that the element 12 and frame 18 can be viewed directly in a horizontal or nearly horizontal direction. The element 12 thus has its plane substantially perpendicular to the viewing direction regardless of which face 26 or 28 is exposed to view.

It should be noted that although when initially energized from a static condition there are opposite repulsion torques acting about the pivots 14, as described above, after motion has been initiated (as seen in FIG. 3), there are repulsion forces acting in the same clockwise direction on the element 12 such that the four magnetic poles operate in unison to move the display element 12 to its reversed position. A rapid response is the result of this coordinated action.

The balancing weight 34 is of a magnitude and is positioned such that a static balance is achieved for the display element 12 about the pivots 14 under a condition where no interacting magnetic fields are present. Additionally, because this is a rotating system, a dynamic balance is also preferred such that the moments of inertia of the masses on both sides of the pivots 14 are equal.

The net difference in rotational forces resulting from interaction of the permanent magnet 24 with the electromagnet 36 can be modified by changing the proportions of the permanent magnet which are positioned on each side of the axis 16 and by modifying the distance from the pole 30 of the permanent magnet 24 from the poles of the electromagnet 36. For example, the apex 30 of the permanent magnet 24 can be cut off to diminish the force acting between that pole and the pole piece 40 as illustrated in FIGS. 1 and 2.

As is common in the flip-type magnetic display devices, the pivoting axis may pass as a diagonal through the corners of the element, with the electromagnetic poles being adjacent the other corners (not shown).

Figure 4:
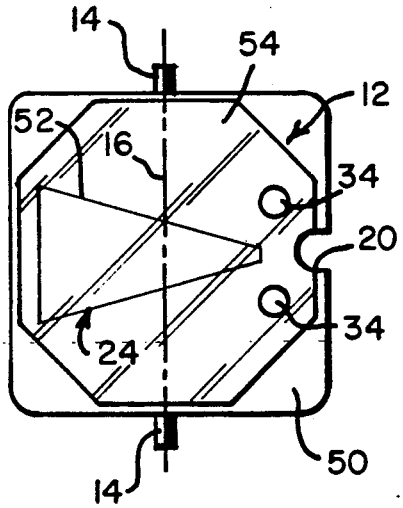
FIG. 4 is a plan view of the display element of the display device of FIG. 1.
Figure 5:
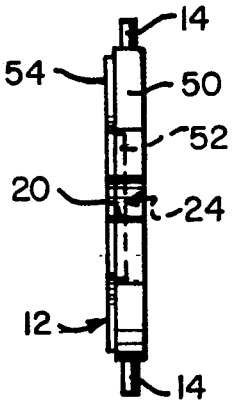
FIG. 5 is a side view of the display element or FIG. 4.

The display element 12 may be made by a two-step injection molding process. In the initial step a back plate 50 is molded having a recess 52 wherein the permanent magnet 24 is placed. The back plate 50 can be, for example, a black polycarbonate such as lexan, ultem, etc. After the magnet 24 is inserted in the recess 52, a front plate 54 is produced and bonded (as in a molding process) to the back plate 50. The front plate is formed of a material of contrasting color, such as yellow. In FIG. 4, the front plate 54 has an octagonal shape. The pivots 14 may be formed when molding either the back plate 50 or the front plate 54.

In a preferred embodiment of a display element 12, the front plate 54 is formed of a clear plastic material with yellow 3M Dayglo type reflective/luminescent particles suspended throughout, of a particle density sufficient to yield a translucent layer in glowing yellow. For clarity in illustration, the front plate 54 is shown as clear plastic, without particles. The basic plastic material may be a polycarbonate such as lexan. By sealing the colored particles within a clear plastic matrix, improved color fade stability and color lifespan are provided, especially for a desirable yellow surface.

The clear plastic matrix in which the yellow particles are suspended provides a partial ultraviolet filter and the large volume of individual color particles in powder form presents a larger surface area to view and exhibits a reduced rate of fading. A display element 12 which is molded by this double injection process also provides improved environmental stability, avoiding disadvantages of display elements of the prior art which are multi-layer laminations using adhesive interfaces, which frequently warp due to differences in expansion and contraction of the dissimilar materials.

Figure 6:
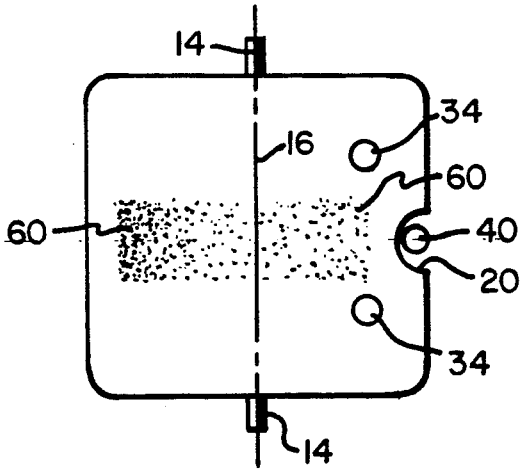
FIG. 6 is a plan view of an alternative element construction in accordance with the invention.

In an alternative embodiment of a magnetically operated display device in accordance with the invention, the permanent magnet may be replaced by metallic magnetizable particles 60 (FIG. 6) which are provided in or after the first step of the injection molding process. Before the plastic hardens, the metallic particles may be attracted predominantly to one side of the pivoting axis 14, 16 by placement in a magnetic field. The force of gravity can also be used to provide an unequal distribution of metallic particles in the molten plastic prior to cooling. The particles may be distributed evenly in a pattern (e.g. triangular) providing more particles on one side of the pivot axis, or may be distributed with uneven diversities in either a regular (e.g. rectangular) or irregular pattern, providing greater magnetic attraction/-repulsion effect on one side of the pivot axis. After the display element is completed in the double injection molding process, the metallic particles may be magnetized in a strong field such that a permanent magnet is produced. The balancing weights 34 may be of any nonmagnetic material and may be inserted in the plastic molding process when the back plate 50 is formed.

In an alternative embodiment of the invention two permanent magnets of unequal strength may be used in the disc element, one magnet on each side of the axis 16 with opposing poles facing the axis 16. The two magnets are then spaced from the axis to provide the desired force imbalance. In another alternative embodiment two equal-strength magnets may be employed at unequal distances from and on opposite sides of the axis. In each construction, balancing weights are preferred to achieve static and dynamic balance as described above.

It should be understood that in an alternative embodiment in accordance with the invention, the display element can be of any shape, for example, rectangular, octagonal, round, etc, generally symmetrical about the pivots 14. As is well understood in the art, the surface appearance of one side of the display element 12 frequently matches the surface, color and texture of the frame 18 as seen from the viewing angle.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limited sense. It is also to be understood that the following claims are intended to cover all of the features of the invention herein described and the scope of the invention is defined by these claims.

What is claimed is:

1. An electromagnetically operated display device comprising:

a frame;

a display unit, including a relatively thin substantially planar disc element having opposite faces with contrasting appearance, said disc element being mounted on said frame for rotation about a rotational axis generally in the plane of said disc element, and a permanent magnet mounted on said element to rotate therewith and defining a magnetic axis between the poles thereof, said magnetic axis being transverse with respect to said rotational axis and substantially co-planar with respect to said disc element;

a pair of magnetic pole pieces fixed in relation to said frame, said pole pieces being located adjacent opposite edges of said disc element when said disc element is displaying either of said opposite faces, said pole pieces being on opposite sides of said rotational axis and arranged relative to the locus of said permanent magnet such that when said pole pieces are oppositely magnetized in a first polarity, said disc element rotates from a first position to a second position, and when said pole pieces are oppositely magnetized in the opposite polarity, said disc element rotates from the second position to the first position; and said permanent magnet having opposite poles which are asymmetrical and differ one from the other in magnetic flux distribution characteristics, the attractive and repulsive interaction of said respective permanent magnet poles with said pole pieces being unequal.

2. A display device as claimed in claim 1, wherein said display unit is statically balanced about said rotational axis.

3. A display device as claimed in claim 2, wherein said disc element is dynamically balanced about said rotational axis.

4. A display device as claimed in claim 3, and further comprising balancing means in said display unit for statically and dynamically balancing said disc element about said rotational axis.

5. A display device as claimed in claim 4, wherein said balancing means includes weights, said weights being a fixed portion of said disc element.

6. A display device as claimed in claim 2, and further comprising balancing means in said disc element for statically balancing said display unit about said rotational axis.

7. A display device as claimed in claim 6, wherein said balancing means includes weights, said weights being a fixed portion of said disc element.

8. A display device as claimed in claim 2, and further comprising stop means limiting rotation of said disc element about said axis to approximately 180 degrees.

9. A display device as claimed in claim 8, wherein said stop means includes a stop portion of said disc element for contacting one said pole piece in said first disc element position and contacting the other pole piece in said second disc element position, said stop portion being on the side of said rotational axis where said permanent magnet has the greater interaction with said pole pieces.

10. A display device as claimed in claim 2, wherein said permanent magnet has a triangular shape, the base of said triangular shape being one pole thereof and the apex opposing said base being the other pole thereof.

11. A display device as claimed in claim 10, wherein said disc element is statically balanced about said rotational axis.

12. A display device as claimed in claim 1, and further comprising stop means limiting rotation of said disc element about said axis to approximately 180 degrees.

13. A display device as claimed in claim 12, wherein said stop means includes a stop portion of said disc element for contacting an end of one said pole piece in said first element position and for contacting an end of the other said pole piece in said second element position, said stop portion being on the side of said rotational axis where said permanent magnet has the greater interaction with said pole pieces.

14. A display device as claimed in claim 13, wherein said disc element includes a cut-out at one edge, opposite to said stop portion, said cut-out providing clearance between said one edge of said disc element and said pole pieces.

15. A display device as claimed in claim 1, wherein said permanent magnet, has a triangular shape, the base of said triangular shape being one pole thereof and the apex opposing said base being the other pole thereof.

16. A display device as claimed in claim 1, wherein said disc element is the product of a double-injection molding process, said permanent magnet being between two layers of non-magnetic material.

17. A display device as claimed in claim 1, wherein said permanent magnet comprises magnetic particles bound in a plastic matrix.

18. A display device as claimed in claim 1, wherein the magnetic axis between the poles of said permanent magnet is substantially aligned with an imaginary plane joining said pole pieces.

19. A display device as claimed in claim 1, wherein said magnetic pole pieces are elements of an electromagnet, said electromagnet further comprising an electrical winding subject to connection with a voltage source of reversible polarity.

20. A display device as claimed in claim 1, wherein said magnetic pole pieces have remanence.

* * * * *